US009072347B2

(12) United States Patent
Hamada et al.

(10) Patent No.: US 9,072,347 B2
(45) Date of Patent: Jul. 7, 2015

(54) SLIDE FASTENER AND SLIDER FOR SLIDE FASTENER

(75) Inventors: Yoshikazu Hamada, Toyama (JP); Keiichi Keyaki, Toyama (JP); Yohei Miyazaki, Toyama (JP)

(73) Assignee: YKK Corporation (JP)

( * ) Notice: Subject to any disclaimer, the term of this patent is extended or adjusted under 35 U.S.C. 154(b) by 198 days.

(21) Appl. No.: 13/820,944

(22) PCT Filed: Sep. 2, 2011

(86) PCT No.: PCT/JP2011/070064

§ 371 (c)(1), (2), (4) Date: Apr. 21, 2013

(87) PCT Pub. No.: WO2012/033024

PCT Pub. Date: Mar. 15, 2012

(65) Prior Publication Data

US 2013/0276270 A1 Oct. 24, 2013

(30) Foreign Application Priority Data

Sep. 6, 2010 (WO) ..... PCT/JP2010/065243

(51) Int. Cl.

*A44B 19/26* (2006.01)
*A44B 19/40* (2006.01)
*A44B 19/30* (2006.01)

(52) U.S. Cl.

CPC ..... *A44B 19/26* (2013.01); *Y10T 24/2582* (2015.01); *Y10T 24/2561* (2015.01); *A44B 19/308* (2013.01); *A44B 19/403* (2013.01)

(58) Field of Classification Search

CPC Y10T 24/2561; Y10T 24/2582; A44B 19/26; A44B 19/403; A44B 19/308

USPC ..... 24/418, 421

See application file for complete search history.

(56) References Cited

U.S. PATENT DOCUMENTS 4,438,550 A * 3/1984 Oda ..... 70/57
4,455,722 A 6/1984 Oda (Continued)

FOREIGN PATENT DOCUMENTS

GB 943136 A 11/1963
JP 58-7203 A 1/1983

(Continued)

OTHER PUBLICATIONS

International Search Report, PCT Application No. PCT/JP2011/070064, mailed Nov. 15, 2011.

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A slider for a slide fastener includes a stopper mechanism formed for "forward use," in which the surface where coiled fastener elements are attached on a fastener tape is the front surface, can be used for "reverse use," in which the surface where the coiled fastener elements are attached on the fastener tape is the back surface. The inner surface of the lower blade of the slider body of a slider has a protrusion that extends in the forward-reverse direction from a guiding bar towards a posterior opening. The protrusion has a first horizontal upper surface on the guide bar end of the protrusion that is highest and a second upper surface on the posterior opening end that is lower than the first upper surface.

7 Claims, 11 Drawing Sheets

(56) References Cited

U.S. PATENT DOCUMENTS

| | | | | |
|---|---|---|---|---|
| 4,662,036 | A * | 5/1987 | Frohlich | 24/421 |
| 4,768,263 | A | 9/1988 | Fukuroi | |
| 5,329,674 | A * | 7/1994 | Tomita et al. | 24/418 |
| 5,603,144 | A * | 2/1997 | Akashi | 24/421 |
| 2002/0038496 | A1 | 4/2002 | Yamagishi et al. | |
| 2003/0056342 | A1* | 3/2003 | Iwase et al. | 24/421 |
| 2009/0019676 | A1 | 1/2009 | Miyazaki et al. | |
| 2009/0288276 | A1* | 11/2009 | Dhanapal | 24/421 |
| 2012/0204384 | A1* | 8/2012 | Miyazaki et al. | 24/420 |
| 2013/0174387 | A1* | 7/2013 | Hamada | 24/418 |
| 2013/0255042 | A1* | 10/2013 | Keyaki et al. | 24/430 |
| 2013/0276270 | A1* | 10/2013 | Hamada et al. | 24/427 |
| 2014/0013549 | A1* | 1/2014 | Oda et al. | 24/415 |
| 2014/0033484 | A1* | 2/2014 | Hamada et al. | 24/418 |
| 2014/0041163 | A1* | 2/2014 | Hamada et al. | 24/418 |
| 2014/0130315 | A1* | 5/2014 | Keyaki et al. | 24/585.1 |

FOREIGN PATENT DOCUMENTS

| | | | |
|---|---|---|---|
| JP | 63-145605 | A | 6/1988 |
| JP | 2002-101917 | A | 4/2002 |
| JP | 2009-22547 | A | 2/2009 |

* cited by examiner

SLIDE FASTENER AND SLIDER FOR SLIDE FASTENER

This application is a national stage application of PCT/JP2011/070064 which is incorporated herein by reference.

BACKGROUND OF THE INVENTION

The present invention relates to a slide fastener and a slider for a slide fastener, and more particularly relates to a slide fastener in which a slider having a stopper function is adopted in a fastener tape of a so-called "rear use" where the surface on which a coil-shaped fastener element is attached is used as a rear surface of the fastener tape, and a slider for such a slide fastener.

BACKGROUND OF THE INVENTION

A slide fastener as one type is known in which a stopper mechanism is incorporated into a slider that can open and close between left and right fastener tapes by a user moving the slider via a pull. One example of such a slider is disclosed in e.g. JP,S63-145605,A. The stopper mechanism includes: a cam shaft for rotatably link the pull to an upper wing plate of the slider; a plate spring, which is located at an initial position when a user does not take the pull and displaced from the initial position by the action of the cam shaft when a user picks up the pull; and a locking pawl that is formed at one end of the plate spring and protrudes through a pawl hole of the upper wing plate to an element guide groove inside the slider, at the initial position of the plate spring. The locking pawl in a protruding state is in contact with an element just before engagement or just after separation in the element guide groove, and the contact can act as resistance and avoid the movement of the slider. On the other hand, when a user takes the pull, the plate spring is displaced withdrawing the locking pawl in the protruding state from the element guide groove. As a result, the slider can be moved.

Further, the fastener tape where the coil-shaped fastener element (element) is attached on its one surface, the surface with the element is usually used as a front surface of the fastener tape (front use). However, because of a fashion or other reasons, there is a case that an element side is used as a rear surface of the fastener tape (rear use). In the case of the front use, the element exists between the upper wing plate of the slider and the fastener tape. On the contrary, in the case of the rear use, the fastener tape is arranged between the upper wing plate and the element. For this reason, if the above stopper mechanism formed for the front use were used in the rear use, the contact between the locking pawl and the element would be insufficient, and the stopper mechanism would not work effectively. Also, producing stopper mechanisms exclusively for the rear use in addition to those for the front use would increase costs, complicate the management of parts and so on.

[Patent Document 1] JP,S63-145605,A

In view of the above-mentioned problems, an object of the invention is to provide a slide fastener and a slider for a slide fastener, in which a stopper mechanism produced for the front use where the surface of a fastener tape on which the coil-shaped fastener element is attached is used as the front surface can be adopted for the rear use where the surface on which the coil-shaped fastener element is attached is used as the rear surface.

SUMMARY OF THE INVENTION

To solve the above-mentioned problems, according to the present invention, there is provided a slide fastener comprising: left and right fastener tapes; left and right coil-shaped fastener elements which are attached onto side ends opposite to each other on the rear surfaces of the left and right fastener tapes, respectively; and a slider for engaging or separating the left and right coil-shaped fastener elements with or from each other, wherein the slider includes a slider body and a stopper mechanism for preventing the movement of the slider body, the slider body including an upper wing plate having a pawl hole, a lower wing plate and a guide post for connecting the upper and lower wing plates, wherein the slider body includes: two front openings which are open on the left and right sides of the guide post between the upper and lower wing plates and through which the left and right coil-shaped fastener elements in a separation state are passed, respectively; one back opening which is open on the side opposite to the guide post in the front-back direction and through which the left and right coil-shaped fastener elements in an engaged state are passed; and a Y-shaped element guide groove which is formed between the front openings and the back opening, wherein the stopper mechanism includes a locking pawl that can protrude to the element guide groove through the pawl hole of the upper wing plate, wherein the lower wing plate has a raised portion on its inner surface, the raised portion extending in the front-back direction from the guide post toward the back opening, wherein the raised portion includes: a first upper face on the side of the guide post, the first upper face being horizontal and the highest in the raised portion; and a second upper surface on the side of the back opening, which is lower than the first upper face, and wherein the locking pawl can engage the coil-shaped fastener elements on the first upper face in a state where the locking pawl protrudes to the element guide groove.

In the invention, in the slide fastener comprising: the fastener tape in which the surface with the coil-shaped fastener elements attached thereon is used as the rear surface; and the slider having the stopper mechanism, the raised portion is provided on the inner surface of the lower wing plate of the slider body in the slider. The raised portion includes the first upper face that is the highest in the raised portion and horizontal (parallel to the inner surface of the lower wing plate), on the guide post side. The locking pawl of the stopper mechanism can engage with the coil-shaped fastener element that is placed on the first upper face and raised upwardly, in a state where the locking pawl protrudes to the element guide groove through the pawl hole. The unit elements adjacent to each other, in the front-back direction, of the coil-shaped fastener element on the first upper face can engage with the locking pawl in a state where the posture of the unit elements is stable at the same height position. The second upper surface on the back opening side, which is lower than the first upper face, can regulate each posture of the coil-shaped fastener elements on the back opening side of the element guide groove and surely keep the engagement state between the engaging heads of the left and right coil-shaped fastener elements. The second upper surface may be horizontal or inclined. When the second upper surface is horizontal, the first upper face and the second upper surface can be connected through an inclined surface. When the second upper surface is inclined, the second upper surface may extend from the end of the first upper face on the engagement opening side to the end of the raised portion on the engagement opening side.

In one embodiment of the invention, at least two unit elements adjacent to each other, in the front-back direction, of the left or right coil-shaped fastener element are placed on the first upper surface. Since the locking pawl comes into between the two unit elements which are being placed on the first upper surface with their postures adjusted, the locking pawl is not easily detached, and a stopper function can work effectively.

In one embodiment of the invention, the first upper surface includes: a uniform width portion on the side of the back opening in which the interval between its left and right sides is constant; and a wide portion in which the interval between its left and right sides is gradually enlarged from the end, on the guide post side, of the uniform width portion toward the guide post, wherein the first upper surface extends toward the back opening until at least the point at which the extension lines of the left and right sides of the wide portion intersect each other. Thereby, the first upper surface extends toward the engagement opening side up to an extent that at least two unit elements adjacent to each other, in the front-back direction, of the left or right coil-shaped fastener element is placed on the first upper surface.

In one embodiment of the invention, the second upper surface is horizontal, and the first upper surface and the second upper surface are connected by an inclined surface. In this case, the second upper surface can regulate the posture of the coil-shaped fastener elements on the back opening side of the element guide groove and surely keep the engagement state between the engaging heads of the left and right coil-shaped fastener elements. Moreover, since the first upper surface and the second upper surface are connected by the inclined surface, the left and right coil-shaped fastener elements can be smoothly moved between the first upper surface and the second upper surface on the raised portion when they are being engaged or disengaged in the element guide groove.

According to another aspect of the present invention, there is provided a slider for a slide fastener, comprising: a slider body which includes an upper wing plate having a pawl hole, a lower wing plate and a guide post for connecting the upper and lower wing plates; and a stopper mechanism for preventing the movement of the slider body, wherein the slider body includes: front openings which are open on the left and right sides of the guide post between the upper and lower wing plates; a back opening which is open on the side opposite to the guide post in the front-back direction; and a Y-shaped element guide groove which is formed between the front openings and the back opening, wherein the stopper mechanism includes a locking pawl that can protrude to the element guide groove through the pawl hole of the upper wing plate, wherein the lower wing plate has a raised portion on its inner side, the raised portion extending in the front-back direction from the guide post toward the back opening, wherein the raised portion includes: a first upper surface on the side of the guide post, the first upper surface being horizontal and the highest in the raised portion; and a second upper surface on the side of the back opening, which is lower than the first upper surface, and wherein the locking pawl can face the first upper surface in a state where the locking pawl protrudes to the element guide groove.

In the invention, in the slider used for a slide fastener, the raised portion is provided on the inner surface of the lower wing plate of the slider body. The raised portion includes the first upper surface that is the highest in the raised portion and horizontal (parallel to the inner surface of the lower wing plate), on the guide post side. The locking pawl of the stopper mechanism can face the first upper surface, in a state where the locking pawl protrudes to the element guide groove through the pawl hole. The unit elements adjacent to each other, in the front-back direction, of the coil-shaped fastener element on the first upper surface can engage with the locking pawl in a state where the posture of the unit elements is stable at the same height position. The second upper surface may be horizontal or inclined. When the second upper surface is horizontal, the first upper surface and the second upper surface can be connected through an inclined surface. When the second upper surface is inclined, the second upper surface may extend from the end of the first upper surface on the engagement opening side to the end of the raised portion on the engagement opening side.

In one embodiment of the invention, the first upper surface includes: a uniform width portion on the side of the back opening in which the interval between its left and right sides is constant; and a wide portion in which the interval between its left and right sides is gradually enlarged from the end of the uniform width portion on the guide post side toward the guide post, wherein the first upper surface extends toward the back opening until at least the point at which the extension lines of the left and right sides of the wide portion intersect each other. Thereby, the first upper surface extends toward the engagement opening side up to an extent that at least two unit elements adjacent to each other, in the front-back direction, of the left or right coil-shaped fastener element is placed on the first upper surface.

In one embodiment of the invention, the second upper surface is horizontal, and the first upper surface and the second upper surface are connected by an inclined surface. In this case, the second upper surface can regulate the posture of the coil-shaped fastener elements on the back opening side of the element guide groove and surely keep the engagement state between the engaging heads of the left and right coil-shaped fastener elements. Moreover, since the first upper surface and the second upper surface are connected by the inclined surface, the left and right coil-shaped fastener elements can be smoothly moved between the first upper surface and the second upper surface on the raised portion when they are being engaged or disengaged in the element guide groove.

In the slide fastener and the slider for a slide fastener according to the invention, with the horizontal first upper surface on the guide post side of the raised portion that is formed on the inner surface of the lower wing plate of the slider, it is possible to stably raise the coil-shaped fastener element in the element guide groove and surely engage the element with the locking pawl in the protruding state. Therefore, the stopper mechanism formed for the front use where the surface of the fastener tape on which the coil-shaped fastener element is attached is used as the front surface can be adopted to the rear use where the surface of the fastener tape on which the coil-shaped fastener element is attached is used as the rear surface.

DETAILED DESCRIPTION OF THE INVENTION

Figure 1:
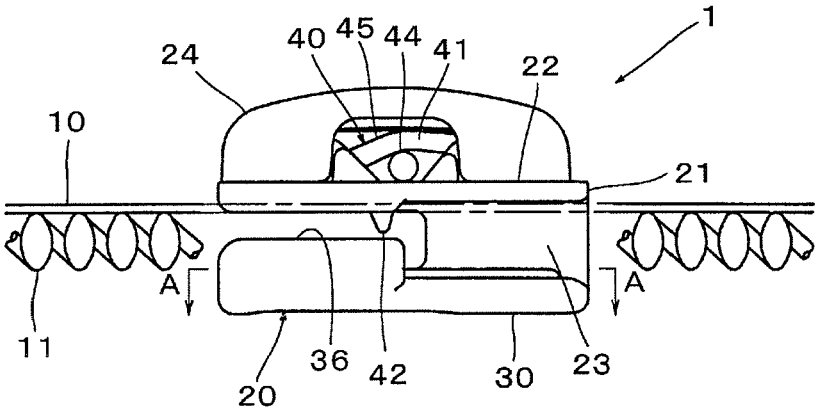
FIG. 1 is a partial side explanation view that schematically shows a slide fastener in accordance with an embodiment of the invention.
Figure 2:
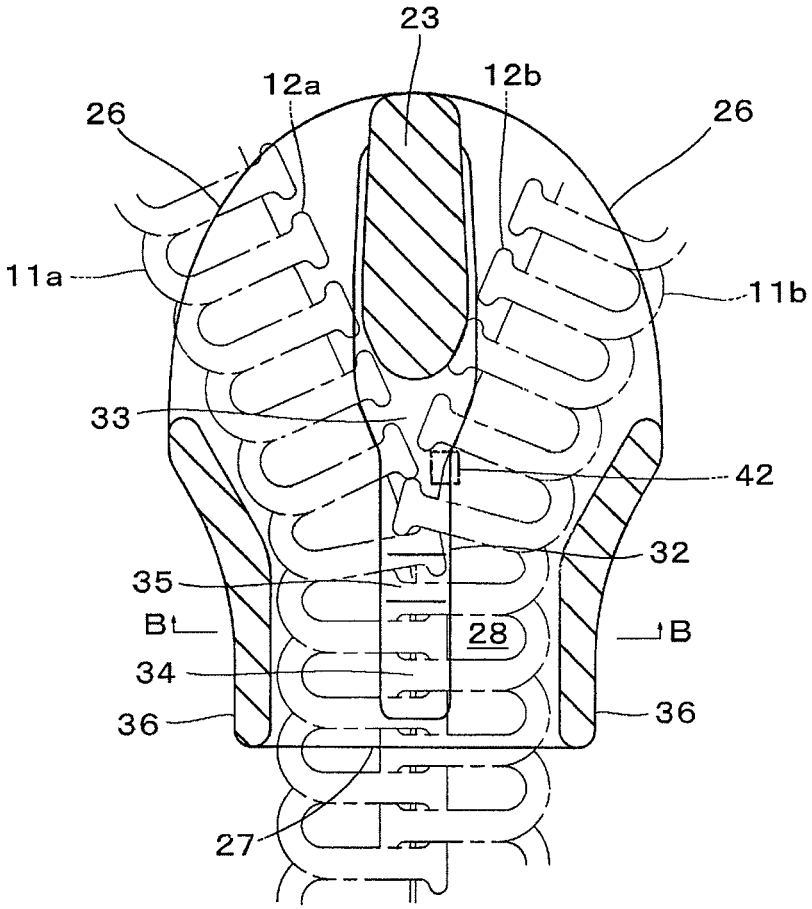
FIG. 2 is a partial cross-sectional plan explanation view of a lower wing plate when viewed from the A-A line in FIG. 1, in which left and right coil-shaped fastener elements are represented by dashed lines.
Figure 3:
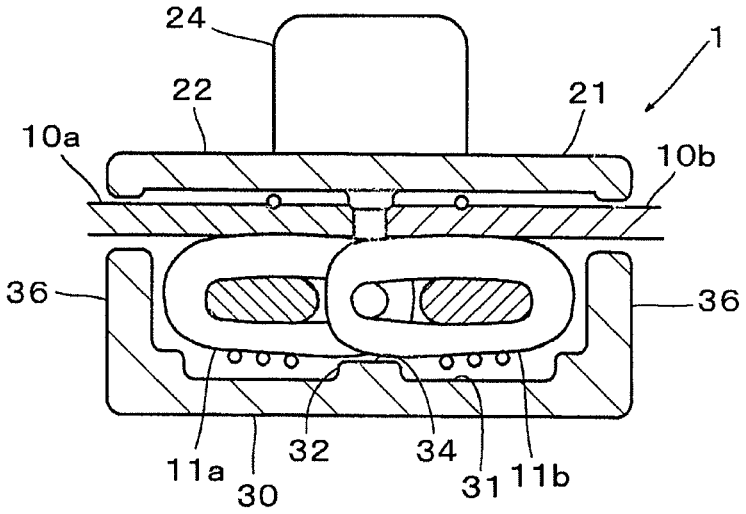
FIG. 3 is a longitudinal cross-sectional explanation view of the slide fastener when viewed from the B-B line in FIG. 2.

Hereinafter, preferable embodiments of the invention will be described with reference to the drawings. FIG. 1 is a partial side explanation view that schematically shows a slide fastener 1 in accordance with an embodiment of the invention. FIG. 2 is a partial cross-sectional plan explanation view of a lower wing plate 30 as described later, when viewed from the A-A line in FIG. 1, in which left and right coil-shaped fastener elements 11 (11*a*, 11*b*) are represented by dashed lines. FIG. 3 is a longitudinal cross-sectional explanation view of the slide fastener 1 when viewed from the B-B line in FIG. 2. The slide fastener 1 includes: a pair of left and right (hereinafter, left-right and upper-lower (or up-down) directions are based on and with respect to the paper face of FIG. 3) fastener tapes 10 (10*a*, 10*b*); a pair of left and right coil-shaped fastener elements (hereinafter also referred to merely as "elements") 11 (11*a*, 11*b*) were sewn at the side ends (open/close edges) opposite to each other on the rear surface (the lower surface in FIGS. 1 and 3) of each of the fastener tapes 10, respectively; and a slider for the slide fastener (hereinafter also referred to merely as "slider") 20 in accordance with the first embodiment of the invention. The slider can be moved in one and the other directions (hereinafter referred to as "front or back direction") along the left and right fastener elements 11 when a user pulls a pull (see the reference numeral 80 in FIG. 10 etc.). For example, when the slider is moved in the one direction (the front direction), the left and right fastener elements 11 in a separation state are engaged, and when the slider is moved in the other direction (the back direction), the left and right fastener elements in an engagement state are separated. The fastener element 11 is a coil-shaped fastener element formed by coiling a monofilament wire, and includes engaging heads 12*a*, 12*b*, each of which can engage the opposite fastener element 11. The slide fastener 1 adopts a so-called "rear use" where the surface of the fastener tape 10 on which the fastener element 11 is attached is used as the rear surface. In the left and right elements 11*a*, 11*b*, when the slider 20 is moved in the front or back direction, the engaging heads 12*a*, 12*b* thereof can be engaged or separated with and from each other, causing the left and right fastener tapes 10*a*, 10*b* to be closed or opened. In each of the left and right elements 11*a*, 11*b*, one turn of the coils adjacent to each other in the front-back direction is referred to as a "unit element" (see the reference numeral 11*c* in FIG. 8). The slider 20 comprises: a slider body (hereinafter also referred to merely as a "body") 21, which includes an upper wing plate 22, a lower wing plate 30 and a guide post 23 for connecting the upper and lower wing plates 22 and 30; the pull as not shown which is rotatably connected to a cover member 24 via a pull shaft 44, the cover member 24 being formed on the upper wing plate 22 of the body 21; and a stopper mechanism 40 that is mounted in the upper wing plate 22 of the body 21 and can prevent the movement of the slider 20 when a user does not take the pull. The pull can be a component of the stopper mechanism 40. The body 21 includes: two front openings 26 which are open on the left and right sides of the guide post 23 between the upper wing plate 22 and the lower wing plate 30 and through which the elements 11*a* and 11*b* in the separation state can pass; one back opening 27 which is open on the side opposite to the guide post 23 in the front-back direction and through which the elements 11*a* and 11*b* in the engaged state can pass; and a Y-shaped element guide groove 28 formed between the front openings 26 and the back opening 27. The reference numerals 29 and 36 indicate flanges of the upper and lower wing plates 22 and 30, and the flanges 29 and 36 form both left and right sides of the element guide groove 28. When the elements 11*a* and 11*b* are passed through the element guide groove 28, the fastener tapes 10*a* and 10*b* except for the parts where the elements 11*a* and 11*b* are attached are passed through the gaps between the upper and lower flanges 29 and 36. The upper flange 29 protrudes downwardly from both of left and right edges of the upper wing plate 22. The lower flange 36 protrudes longer than the upper flange 29, upwardly from both of left and right edges of the lower wing plate 30. Also, the lower flanges 36 help guide U-shaped turn parts 13*a* and 13*b* (see FIG. 3), opposite side of the engaging heads 12*a*, 12*b*, of the elements 11*a* and 11*b*, the U-shaped turn parts 13*a* and 13*b* connecting between the unit elements 11*c* (see FIG. 8).

Figure 6:
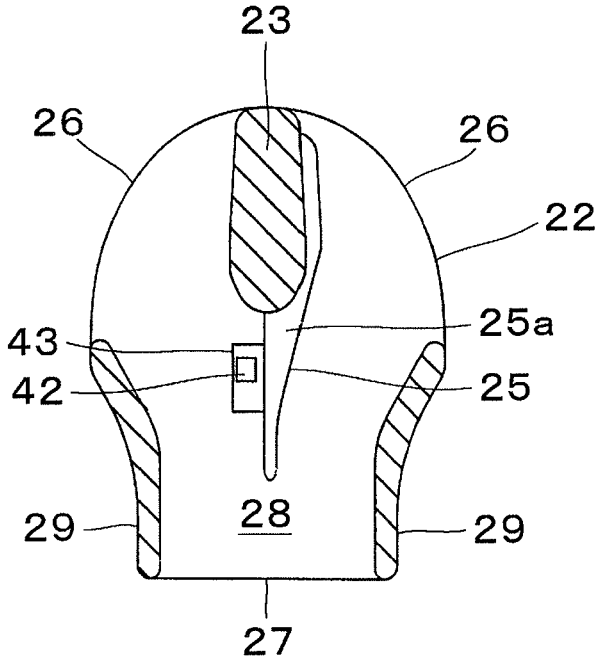
FIG. 6 is a partial cross-sectional explanation view of an upper wing plate of the slider when viewed from its lower surface side.

As the stopper mechanism 40, it is possible to use conventional stopper mechanisms for a slide fastener, and it can be the same as disclosed in JP,S63-145605,A. As an example, the stopper mechanism 40 includes a stopper member 41 having a locking pawl 42 at one end, and a plate spring 45 for pushing the locking pawl 42 of the stopper member 41 so as to protrude into the element guide groove 28. In the stopper mechanism 40, the stopper member 41 and the plate spring 45 are accommodated in a cover member 24, the pull shaft 44 of the pull is arranged between the stopper member 41 and the upper surface of the upper wing plate 22, and the pull is attached to the body 21. When a user does not take the pull, the locking pawl 42 protrudes to the lower element guide groove 28 through a pawl hole 43 (see FIG. 6) formed in the upper wing plate 22 by the elastic bias from the plate spring 45. Thereby, the locking pawl 42 is brought into contact with the element 11 just before the engagement or just after the separation in the element guide groove 28 (see FIG. 2). Then, this contact or engagement can serve as resistant to the movement of the slider 20. On the other hand, when a user takes and operates the pull, the pull is stood up with respect to the upper wing plate 22, and the pull shaft 44 of the pull displaces the stopper member 41 against the elastic bias from the plate spring 45. This withdraws upwardly the locking pawl 42 from the protruding state, causing the slider 20 to be movable. When a user releases the pull from this state, the locking pawl 42 is returned into the protruding state. The pawl hole 43 is formed on the slightly right side from the center of the left-right direction of the upper wing plate 22 from the viewpoint of the paper face of FIG. 2 (in FIG. 6 showing the upper wing plate 22 as viewed from the bottom, the pawl hole 43 is located on the slightly left side from the center). For this reason, the locking pawl 42 in the protruding state can engage with the engaging head 12*b* of the element 11*b* on the right side just before the engagement or just after the separation as shown in FIG. 2. The stopper mechanism 40 has been produced for the so-called "front use" where the surface of the fastener tape on which the coil-shaped fastener element is attached is usually used as the front surface. Therefore, in the slide fastener 1 used for the rear use as mentioned above, the fastener tape 10 exists between the fastener element 11 and the lower surface of the upper wing plate 22. Then, as compared with the front use, the position of the coil-shaped fastener element is downwardly shifted, which disables the locking pawl 42 in the protruding state to be firmly in contact with the element. Thus, the stopper function cannot work sufficiently. In order to correct the matter, the lower wing plate 30 of the slider 20 of the slide fastener 1 is configured as described below. As mentioned above, in the slide fastener for the "rear use", the fastener element 11 is provided on the rear side of the fastener tape 10. Hence, as shown in FIG. 3, the elements 11 are located on the lower wing plate 30 side, and therefore the elements 11 can be in contact with the upper surface of the lower wing plate 30 and the upper surface of a raised portion 32 as described later. In particular, to regulate the posture of the fastener elements 11 in the element guide groove 28, the raised portion 32 is formed to protrude from the upper surface 31 of the lower wing plate 30 so as to more easily contact the fastener elements 11.

Figure 4:
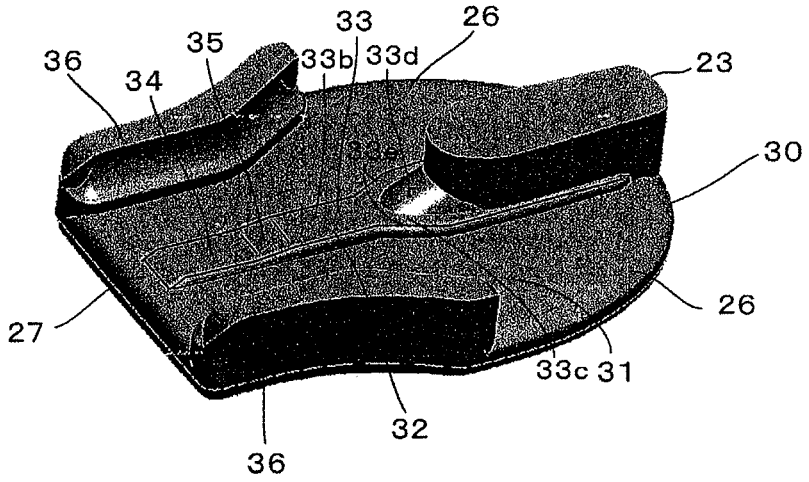
FIG. 4 is a perspective view of the lower wing plate.
Figure 5:
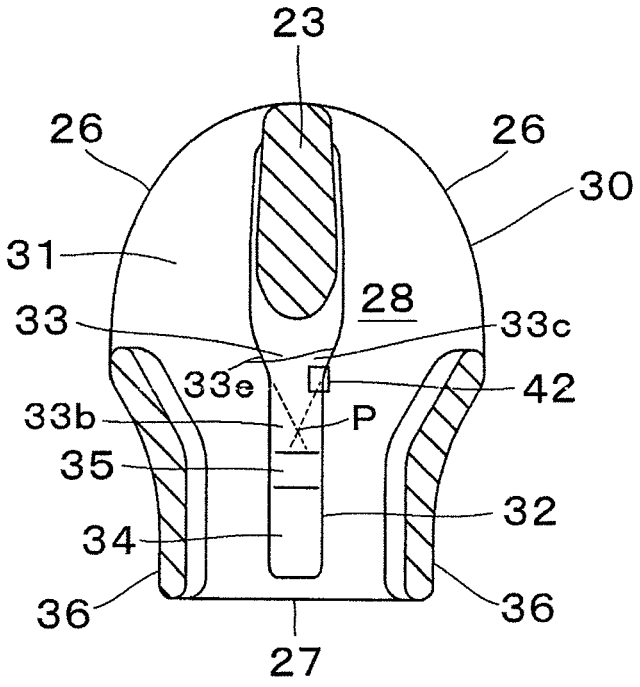
FIG. 5 is a partial cross-sectional explanation view of the a lower wing plate of the slider when viewed from its upper surface (inner surface) side.
Figure 7:
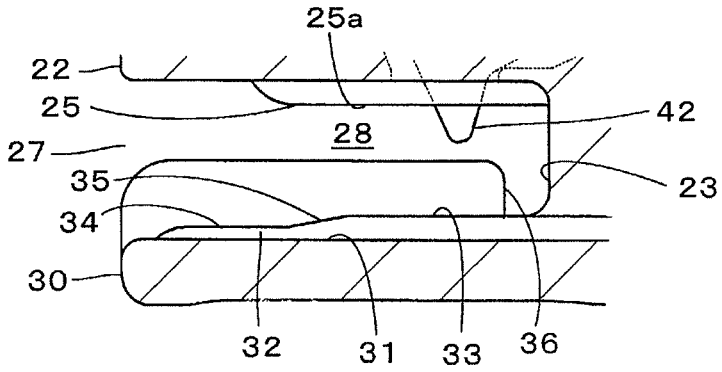
FIG. 7 is a partial cross-sectional explanation view where a raised portion of the lower wing plate, a raised portion of the upper wing plate and a locking pawl in the protruding state are viewed from a side.

FIG. 4 is a perspective view of the lower wing plate 30. FIG. 5 shows the upper surface (inner surface) 31 of the lower wing plate 30, in which the guide post 23 and the lower flange 36 are represented in horizontal cross-section. The lower wing plate 30 has the raised portion 32, which extends, on the upper surface 31, in the front-back direction at the center of the left-right direction from lower end portions of the left and right sides of the guide post 23 to the vicinity of a back opening 27. The upper surface 31 of the lower wing plate 30 is orthogonal to the up-down direction and parallel to the lower surface of the upper wing plate 22. Hereafter, a surface parallel to the upper surface 31 is referred to as a "horizontal (surface)". As shown in FIG. 7 etc., the raised portion 32 includes: a first upper surface 33 that is flat and horizontal on the side of the guide post 23; a second upper surface 34 whose height from the inner surface 31 of the lower wing plate 30 is slightly shorter than that of the first upper surface 33, and which is flat and horizontal on the side of the back opening 27; and a inclined surface 35 that connects the first upper surface 33 with the second upper surface 34. The inclined surface 35 declines downwardly from the first upper surface 33 to the second upper surface 34 (the decline where the height from the upper surface 31 of the lower wing plate 30 is gradually reduced from the side of the guide post 23 side to the back opening 27). The height of the raised portion 32 from the inner side 31 (the protruding dimension) is higher on the guide post 23 side than on the back opening 27 side. The first upper surface 33 is branched into two on the guide post 23 side extending along both left and right sides of the lower end portions of the guide post 23 to the vicinity of one end of the guide post 23, in front-back direction, opposite to the back opening 27. The width of the first upper surface 33 in the left-right direction is greater on the guide post 23 side than on the back opening 27 side. The first upper surface 33 includes: a uniform width portion 33*b* which is adjacent to the inclined surface 35 and on the back opening 27 side, the left and right sides of the uniform width portion 33*b* being parallel to each other and the interval between the left and right sides being constant; and a wide portion 33*c* in which the interval between its left and right sides 33*e*, 33*e* (the whole interval including a dent 33*d* shown in only FIG. 4) is gradually enlarged from the guide post 23 side (front side) end of the uniform width portion 33*b*. The first upper surface 33 further extends from the guide post 23 side end of the wide portion 33*c* to the lower end portions on the left and right sides of the guide post 23. With reference to FIG. 5, the left and right sides 33*e*, 33*e* of the wide portion 33*c* slant with respect to the left and right sides of the uniform width portion 33*b*. When the point at which respective extension lines of the left and right sides 33*e*, 33*e* intersect on the upper surface of the raised portion 32 is defined as P, the uniform width portion 33*b* or the first upper surface 33 is formed to extend, from the guide post 23 side to the back opening 27 side, at least to the point P. That is, the second upper surface 34 and the inclined surface 35 lie on the back opening 27 side from the point P. The inclined surface 35 may be arranged on the back opening 27 side directly from the position of the point P. The back opening 27 side end of the raised portion 32 is gently declined to the upper surface 31 from the back opening 27 side end of the second upper surface 34. Also with reference to FIG. 2, the first upper surface 33 lies in a region just before the engaging heads 12*a*, 12*b* of the left and right elements 11*a*, 11*b* are engaged or just after they are separated (the just before engagement or after separation region) in the element guide groove 28. This region includes the pawl hole 43 through which the locking pawl 42 of the stopper mechanism 40 is protruded or withdrawn as mentioned above. The pawl hole 43 is located at the position corresponding to about the boundary between the uniform width portion 33*b* and the wide portion 33*c* in the first upper surface 33. Thus, when the locking pawl 42 protrudes to the element guide groove 28 through the pawl hole 43, the locking pawl 42 is placed to point to about the boundary between the uniform width portion 33*b* and the wide portion 33*c* in the first upper surface 33. The second upper surface 34 is located in a region after the left and right elements 11*a*, 11*b* are engaged or before they are separated (the after engagement or before separation region), in the element guide groove 28. The inclined surface 35 is located in a region between the just before engagement or after separation region and the after engagement or before separation region in the element guide groove 28. In this region, the engaging heads 12*a*, 12*b* of the left and right elements 11*a*, 11*b* start to be engaged or separated.

FIG. 6 shows the lower surface of the upper wing plate 22 in which the guide post 23 and the upper flange 29 are indicated in horizontal cross-section. The upper wing plate 22 has, on the lower surface, a raised portion 25 that extends in the front-back direction at almost the center in the left-right direction from the lower end portion on the left side (the right side in FIG. 6) of the guide post 23 to the back opening 27 side. The raised portion 25 exists only on the left side (the right side in FIG. 6) from the central line of the left-right direction, and the pawl hole 43 is formed on the right side (the left side in FIG. 6) from the central line of the left-right direction as mentioned above. The raised portion 25 extends toward the back opening 27 while gradually reducing the width in the left-right direction until the back opening 27 side end of the pawl hole 43, and then further extending somewhat with a constant width. The raised portion 25 terminates away from the back opening 27 rather than the raised portion 32 of the lower wing plate 30. The width in the left-right direction of the raised portion 32 of the lower wing plate 30 is greater than that of the raised portion 25 of the upper wing plate 22. FIG. 7 is a side explanation view showing the raised portion 32 of the lower wing plate 30, the raised portion 25 of the upper wing plate 22, and the locking pawl 42. The lower surface 25*a* of the raised portion 25 of the upper wing plate 22 is a flat, horizontal surface and extends toward the back opening 27 until close to the boundary between the second upper surface 34 and the inclined surface 35 of the raised portion 32 of the lower wing plate 30.

Figure 8:
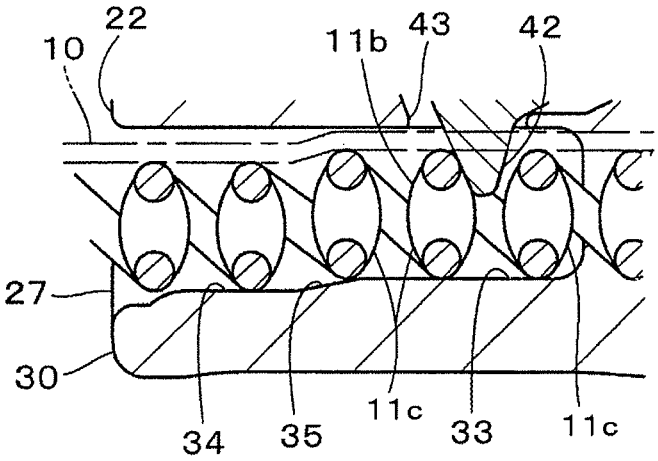
FIG. 8 is a longitudinal cross-sectional explanation view that schematically shows an engaging state between the locking pawl in the protruding state and the coil-shaped fastener element.

In the slide fastener 1 as configured above, when a user does not take the pull, namely does not operate the opening or closing between the left and right fastener tapes 10*a*, 10*b*, the locking pawl 42 of the stopper mechanism 40 is protruded to the inside of the element guide groove 28 through the pawl hole 43 by the elastic bias, becoming in the protruding state. At this time, the first upper surface 33 of the raised portion 32 of the lower wing plate 30 is slightly raising the coil-shaped fastener element 11*b* on the right side lying in the just before engagement or after separation region in the element guide groove 28. Thereby, as shown in FIG. 8, the element 11*b* can comes close to the locking pawl 42 causing the element 11*b* to be surely in contact with the locking pawl 42 in the protruding state. Thereby, the intended stopper function can work and prevent the slider 20 from moving. Further, with reference to FIG. 8, as mentioned above, the horizontal first upper surface 33 is formed to extend toward the back opening 27 till at least the point P (see FIG. 5). Therefore, at least two unit elements 11*c* adjacent to the element 11 in the front-back direction are placed on the uniform width portion 33*b* and the wide portion 33*c* of the first upper surface 33, so these unit elements are at the same height. Thereby, since the locking pawl 42 is inserted between the two adjacent unit elements 11*c* whose postures are adjusted at the same height on the first upper surface 33, the locking pawl 42 would not easily come off between the engaging heads 12*b*, and the stopper function can work effectively. When a user takes the pull to operate the opening or closing between the left and right fastener tapes 10*a*, 10*b*, the locking pawl 42 will be withdrawn from the element guide groove 28 upwardly with respect to the lower surface of the upper wing plate 22 via a displacement of the stopper member 41 by the pull shaft 44. Consequently, the slider 20 can be moved. In this opening and closing operation, the raised portion 32 of the lower wing plate 30 slightly narrows the up-down interval of the element guide groove 28 through which the elements 11 are passed, and reduces a displacement, in the up-down direction, of the engaging heads 12*a*, 12*b* of the elements 11*a*, 11*b*. Further, since the width of the left-right direction of the first upper surface 33 is greater on the guide post 23 side than the back opening 27 side, when the left and right elements 11*a*, 11*b* in the separation state are being engaged, the elements 11*a*, 11*b* can be smoothly raised onto the first upper surface 33, and therefore the element 11 can surely contact the locking pawl 42. Moreover, the second upper surface 34 of the raised portion 32 can regulate the postures of the engaging heads 12*a*, 12*b* of the left and right elements 11*a*, 11*b* by slightly narrowing the up-down interval of the after engagement or before separation region in the element guide groove 28, making the engagement between the engaging heads 12*a*, 12*b* more reliable. This can also help to surely keep the engagement state between the engaging heads 12*a*, 12*b*. When the elements 11*a*, 11*b* are being engaged or separated, they are smoothly moved through the inclined surface 35 between the first upper surface 33 and the second upper surface 34 on the raised portion 32.

Figure 9:
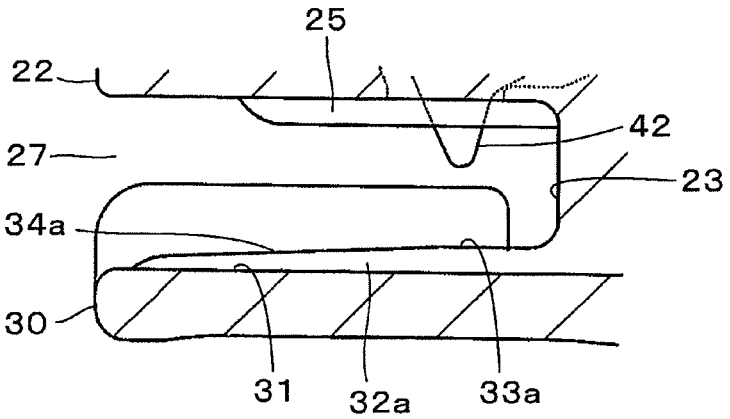
FIG. 9 is a partial cross-sectional explanation view, similar to FIG. 7, that shows another example of the raised portion of the lower wing plate.

As stated above, in the slide fastener 1, the locking pawl 42 and the coil-shaped fastener element 11 are surely engaged or contacted in the slider used for the rear use. Thus, the stopper mechanism can function, and the stopper mechanism 40 for the front use can be applied to the slide fastener 1 including the fastener tapes 10 with the coil-shaped fastener elements 11 for the rear use. In the above-stated embodiment, an example where the first upper surface 33 and the second upper surface 34 of the raised portion 32 are connected by the inclined surface 35 is quoted, but the invention is not limited thereto. FIG. 9 shows another example of the raised portion. This raised portion 32*a* includes: a first upper surface 33*a* on the guide post 23 side (the same reference numerals as in FIG. 7 etc. are used except for the raised portion), which is flat and horizontal; and a second upper surface 34*a* which is inclined such that its height is gradually reduced from the back opening 27 side end of the first upper surface 33*a* toward the back opening 27. In this case, the inclined second upper surface 34*a* is directly connected to the first upper surface 33*a*. The length of the first upper surface 33*a* in the front-back direction is shorter than that of the first upper surface 33 of the raised portion 32 shown in FIG. 7 etc. However, although not shown, the first upper surface 33*a* in FIG. 9 also extends till the point P in FIG. 5 on the back opening 27 side. In other words, the boundary between the first upper surface 33*a* and the second upper surface 34*a* is located at the position of the point P or a position on the back opening 27 side from the point P. On the first upper surface 33*a*, at least two unit elements 11*c* adjacent to each other in the front-back direction of the element 11*b* can be placed.

In the above explanation, on the front surface (the surface opposite to the surface with the fastener element 11 attached) of the fastener tape 10, a resin layer is formed by sticking a film-like thermoplastic elastomer with adhesive agent or coating a melted resin in a thin manner. Thereby, a slider for a slide fastener includes the fastener tape with a resin layer.

Figure 10:
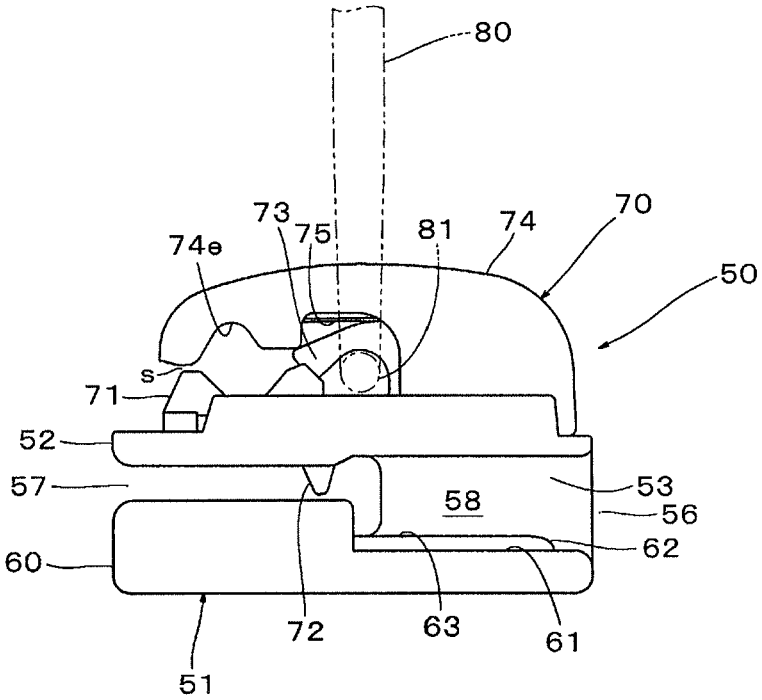
FIG. 10 is a side view of a slider in accordance with a second embodiment.
Figure 11:
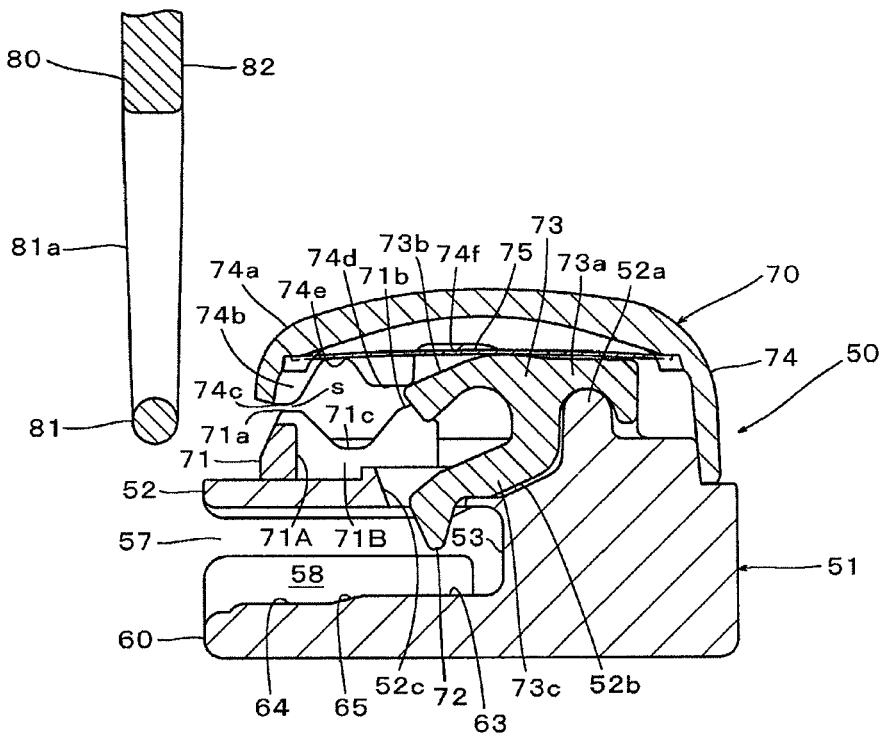
FIG. 11 is a cross-sectional explanation view of the slider in FIG. 10 in a state before a pull is attached thereto.

Next, a slider 50 in accordance with a second embodiment of the invention will be described below. FIG. 10 is a side view of the slider 50. FIG. 11 is a cross-sectional explanation view of the slider 50 in a state before a pull 80 is connected thereto. The slider 50 is configured to be substantially similar to the slide fastener slider as disclosed in JP,2008-228808,A, except for a raised portion 62 formed on the upper surface 61 of a lower wing plate 60 as described later. The slider 50 can construct the slide fastener for the rear use by being applied to the fastener tapes 10 where the elements 11 are attached on the rear surface, in place of the slider 10 including the above-described stopper mechanism 40. The slider 50 comprises: a slider body 51, which includes an upper wing plate 52, the lower wing plate 60, and a guide post 53 for linking these upper and lower wing plates 52 and 60; and a stopper mechanism 70, which is mounted on the upper wing plate 52 of the slider body 51 and can prevent the movement of the slider 20 when a user does not take the pull 80. The slider body 51 has almost the same construction as the slider body 21 of the slider 20 in the first embodiment except for parts to which the stopper mechanism 70 is mounted. The slider body 51 includes: two front openings that are open on the left and right sides of the guide post 53 and between the upper wing plate 52 and the lower wing plate 60; a back opening 57 that is open on the side opposite to the guide post 53 in the front-back direction; and a Y-shaped element guide groove 58 which is formed between the front openings 56 and the back opening 57.

The stopper mechanism 70 comprises: an opening/closing member 71 that is attached on the back side (the left side in FIG. 10 etc.; the right side in FIG. 10 etc. represents the front side) of the upper surface of the upper wing plate 52 slidably in the front-back direction; a coil spring (not shown) that always pushes or biases backward the opening/closing member 71; a plate-shaped locking pawl body 73 that is arranged on the front side of the upper surface of the upper wing plate 52, the locking pawl body 73 including a locking pawl 72; a food-like pull holder 74 that covers above the opening/closing member 71 and around the locking pawl body 73; a plate spring 75 that is substantially horizontally attached inside and above the pull holder 74 and biases always the locking pawl body 73 downward; and a pull 80 that can be attached and detached.

The opening/closing member 71 is usually at an initial position shown in FIGS. 10 and 11 by being pushed backward by the coil spring. The opening/closing member 71 cannot be moved backward further beyond this initial position. The opening/closing member 71 comprises a back end part 71A extending in the left-right direction and left and right side plates 71B extending forward from the left and right ends of the back end part 71A, respectively. Each of the left and right side plates 71B includes: a first mountain 71*a* on the front side; a second mountain 71*b* on the back side, the first and second mountains 71*a* and 71*b* bulging upwardly; and a valley 71*c* that is recessed downwardly between the first and second mountains 71*a* and 71*b*. The locking pawl body 73 includes: a base part 73*a*, which is supported by a supporting part 52*a* projecting upwardly on the front side of the upper surface of the upper wing plate 52, the supporting part 52*a* having an arc-like cross-sectional apex; and an upper arm 73*b* and a lower arm 73*c* that extend backward in a furcated manner from the base end 73*a*. Then, the tip of the lower arm 73*c* serves as a locking pawl 72. A supported portion 73*d* of the base end 73*a* which corresponds to the apex of the supporting part 52*a* is in a concave, arc-like cross-section. The locking pawl body 73 can somewhat swing in the up-down direction centering around the supported portion 73*d*. The locking pawl body 73 is usually at an initial position shown in FIG. 11 by the bias from the plate spring 75. At this initial position, the lower arm 73*c* strikes against an inclined part 52*b* and is limited to swing further downwardly. The inclined part 52*b* is inclined backward and downward from the lower end of the supporting portion 52*a* on the upper surface of the upper wing plate 52. Also in the initial position, the locking pawl 72 protrudes to the lower element guide groove 58 through the pawl hole 52*c* and contacts the element (not shown), preventing the he slider body 51 from moving.

The pull holder 74 includes: a center plate 74*a* that extends in the front-back direction while slightly curving upward convexly; left and right side plates 74*b* that extends downwardly from the left and right sides of the center plate 74*a*. Almost front halves of both of the center plate 74*a* and the left and right side plates 74*b* are connected to the upper surface of the upper wing plate 52. On the other hand, almost back halves of both of the center plate 74*a* and the left and right side plates 74*b* are spaced with respect to the upper surface of the upper wing plate 52. The back end of the center plate 74*a* of the pull holder 74 is located close to the back end of the opening/closing member 71 in the initial position with a small gap s. This small gap s is smaller than the diameter of a shaft 81 of the pull 80 as described later. Each of the left and right side plates 74*b* of the pull holder 74 includes a first convex portion 74*c* at the back end, which is downwardly convex, a second convex portion 74*d* at a front side rather than the first convex portion 74*c*, which is downwardly convex, a first concave portion 74*e* between the first and second convex portions 74*c* and 74*d*, which is upwardly concave, and a second concave portion 74*f* adjacent to the front side of the second convex portion 74*d*. The first and second convex portions 74*c* and 74*d* are close to the first and second mountains 71*a* and 71*b* of the opening/closing member 71 in the initial position, respectively, with small gaps smaller than the diameter of the shaft 81 of the pull 80. The pull 80 includes a pull body 82 (see FIG. 11) having the front and rear surfaces on which a logo and the like can be engraved, and a rectangular annular part 81*a* that extends from the pull body 82. The rectangular annular portion 81*a* has a shaft 81, which is to be held by the pull holder 74 etc. as described below.

Figure 12:
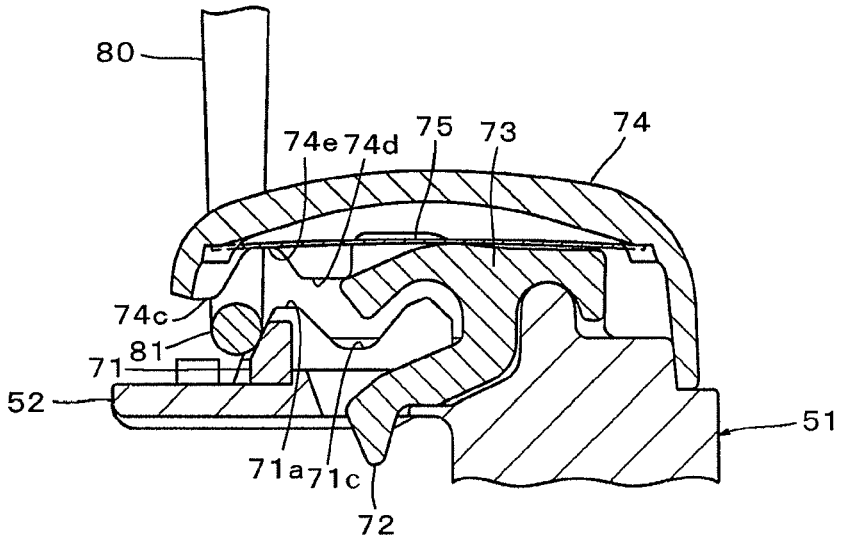
FIG. 12 is a cross-sectional explanation view of the slider that shows a process for attaching the pull thereto.
Figure 13:
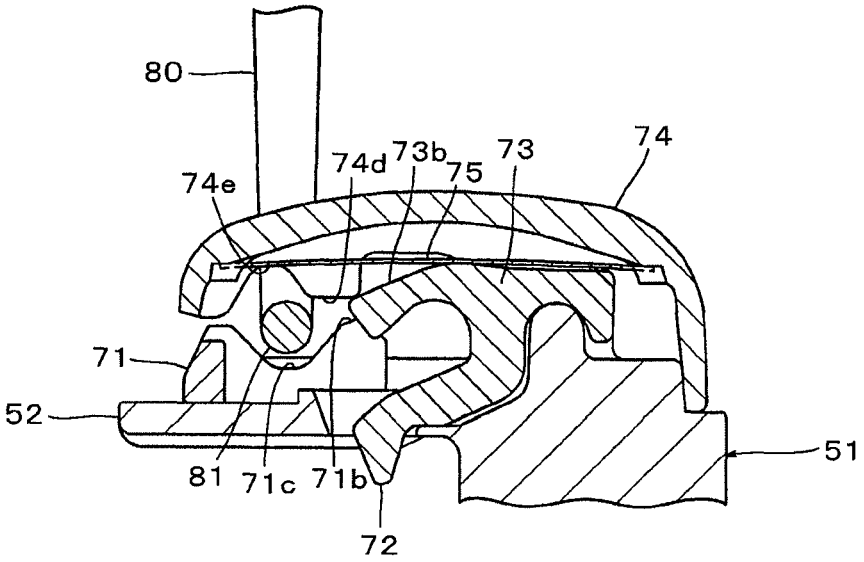
FIG. 13 is a cross-sectional explanation view of the slider that shows a process for attaching the pull thereto.
Figure 14:
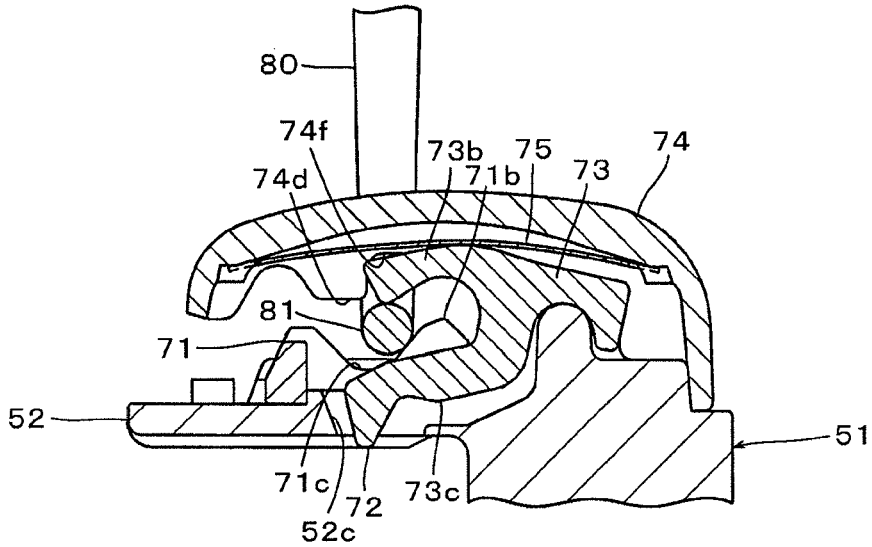
FIG. 14 is a cross-sectional explanation view of the slider that shows a process for attaching the pull thereto.
Figure 15:
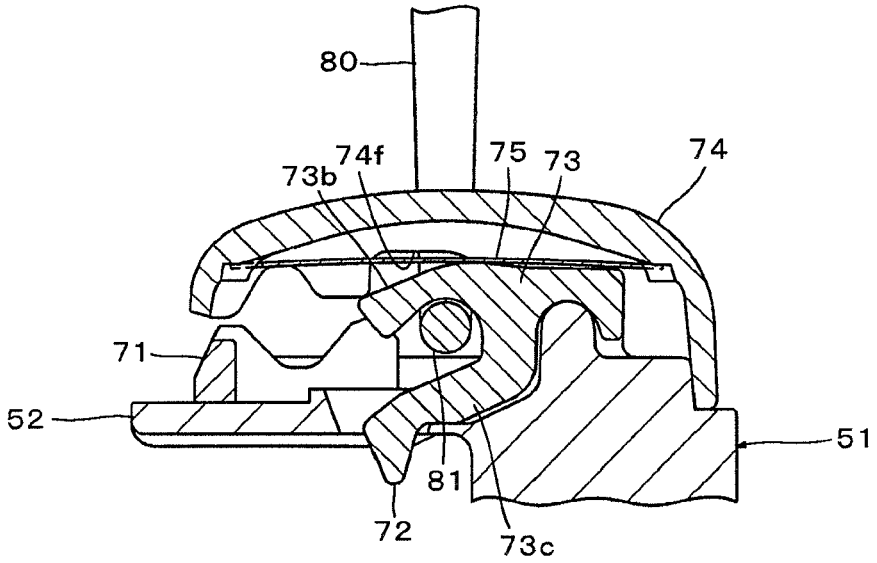
FIG. 15 is a cross-sectional explanation view of the slider in a state where the attachment of the pull is completed.

Next, a process of connecting the pull 80 to the pull holder 74 etc. will be described with reference to FIGS. 12 to 15. Firstly, the shaft 81 of the pull 80 is forcedly pushed into the small gap s between the back end part 71A of the opening/closing member 71 and the back end of the pull holder 74. Thereby, the opening/closing member 71 is displaced forwardly against the bias of the coil spring (FIG. 12). Next, the shaft 81 is moved upwardly to the first concave portions 74*e* of the left and right side plates 74*b* of the pull holder 74. Thereby the opening/closing member 71 is returned to the initial position by the bias of the coil spring (FIG. 13). At this time, the shaft 81 exists inside the relatively large gap between the valleys 71*c* of the opening/closing member 71 and the first concave portions 74*e* of the pull holder 74. Next, the second mountain 71*b* of the opening/closing member 71 of the pull holder 74 is pushed forwardly by the shaft 81. Thereby, as shown in FIG. 14, the shaft 81 arrives at a position, in the front-back direction, corresponding to the second concave portion 74*f* of the pull holder 74 and comes into between the upper and lower arms 73*b* and 73*c* of the locking pawl body 73. At this time, the shaft 81 raises the upper arm 73*b* slightly upward. Thereby, the plate spring 75 is curved to be slightly upward convex (FIG. 14). After the shaft 81 gets over the second mountains 71*b* of the opening/closing member 71, as shown in FIG. 15, the opening/closing member 71 and the plate spring 75 are returned to the respective initial positions, completing the attaching process of the pull 80. It is difficult to move the opening/closing member 71 by using the shaft 81 at the attachment completed position. Therefore, the pull 80 cannot be detached by itself. However, if the opening/closing member 71 is pushed forwardly by using a separate bar-shaped member and the like through the small gap s, the shaft 81 can be detached from the pull holder 74 in the reverse procedure of the above-mentioned one.

In the state in FIG. 15, the locking pawl 72 protrudes to the lower element guide groove 58 through the pawl hole 52*c* and therefore can prevent the movement of the slider 50. However, when a user pulls the pull 80, the locking pawl body 73 swings upwardly by the shaft 81 against the bias of the plate spring 75, though not shown. Thereby, the locking pawl 72 is withdrawn from the element guide groove 58, and the slider 50 can be moved. The slider 50 has the raised portion 62 on the upper surface 61 of the lower wing plate 60. The raised portion 62 includes: a first surface 63 on the guide post 53 side, the first surface 63 being flat and horizontal; a second surface 64 on the back opening 57 side, the second surface 64 being flat and horizontal; and an inclined surface 65 that connects between the first surface 63 and the second surface 64. The first surface 63 extends toward the back opening 57 up to at least a point corresponding to the point P in FIG. 5. The locking pawl 74 is arranged to face the first upper surface 63 as the locking pawl 74 protrudes to the element guide groove 58 through the pawl hole 52*c*.

DESCRIPTION OF REFERENCE NUMBERS

1 slide fastener
10 (10*a*, 10*b*) fastener tape
11 (11*a*, 11*b*) coil-shaped fastener element
20, 50 slider
22, 52 upper wing plate
23, 53 guide post
25 raised portion of upper wing plate

25*a* lower surface of raised portion
26, 56 front opening
27, 57 back opening
28, 58 element guide groove
30, 60 lower wing plate
32, 32*a*, 62 raised portion of lower wing plate
33, 33*a*, 63 first upper surface
34, 34*a*, 64 second upper surface
35, 65 inclined surface
40, 70 stopper mechanism
42, 72 locking pawl
43, 52*c* pawl hole
80 pull
82 shaft of pull

The invention claimed is:

1. A slide fastener comprising:

left and right fastener tapes;

left and right coil-shaped fastener elements which are attached onto side ends opposite to each other on rear surfaces of the left and right fastener tapes, respectively; and a slider for engaging or separating the left and right coil-shaped fastener elements with or from each other, wherein the slider includes a slider body and a stopper mechanism for preventing movement of the slider body, the slider body including an upper wing plate having a pawl hole, a lower wing plate and a guide post for connecting the upper and lower wing plates, wherein the slider body includes: two front openings which are open on left and right sides of the guide post between the upper and lower wing plates and through which the left and right coil-shaped fastener elements in a separation state are passed, respectively; one back opening which is open on a side opposite to the guide post in a front-back direction and through which the left and right coil-shaped fastener elements in an engaged state are passed; and a Y-shaped element guide groove which is formed between the front openings and the back opening, wherein the stopper mechanism includes a locking pawl that can protrude to the element guide groove through the pawl hole of the upper wing plate, wherein the lower wing plate has a raised portion on its inner surface, the raised portion extending in the front-back direction from the guide post toward the back opening, wherein the raised portion includes: a first upper surface on a side of the guide post, the first upper surface being horizontal and a highest surface of the raised portion; and a second upper surface on a side of the back opening, which is lower than the first upper surface, wherein the second upper surface is horizontal, and the first upper surface and the second upper surface are connected by an inclined surface, and wherein the locking pawl can engage the coil-shaped fastener elements on the first upper surface in a state where the locking pawl protrudes to the element guide groove.

2. The slide fastener according to claim 1, wherein at least two unit elements adjacent to each other, in the front-back direction, of the left or right coil-shaped fastener element are placed on the first upper surface.

3. The slide fastener according to claim 1, wherein the first upper surface includes: a uniform width portion on the side of the back opening in which an interval between its left and right sides is constant; and a wide portion in which the interval between its left and right sides is gradually enlarged from an end of the uniform width portion on the guide post side toward the guide post, wherein the first upper surface extends toward the back opening until at least a point at which extension lines of the left and right sides of the wide portion intersect each other.

4. The slide fastener according to claim 1, wherein the first upper surface includes: a uniform width portion, its left and right sides being parallel to each other; and a wide portion in which an interval between its left and right sides is gradually enlarged from an end of the uniform width portion on the guide post side, wherein the uniform width portion is adjacent to the inclined surface.

5. A slider for a slide fastener, comprising:

a slider body which includes an upper wing plate having a pawl hole, a lower wing plate and a guide post for connecting the upper and lower wing plates; and a stopper mechanism for preventing movement of the slider body, wherein the slider body includes: front openings which are open on left and right sides of the guide post between the upper and lower wing plates; a back opening which is open on a side opposite to the guide post in a front-back direction; and a Y-shaped element guide groove which is formed between the front openings and the back opening, wherein the stopper mechanism includes a locking pawl that can protrude to the element guide groove through the pawl hole of the upper wing plate, wherein the lower wing plate has a raised portion on its inner surface, the raised portion extending in the front-back direction from the guide post toward the back opening, wherein the raised portion includes: a first upper surface on a side of the guide post, the first upper surface being horizontal and a highest surface of the raised portion; and a second upper surface on a side of the back opening, which is lower than the first upper surface, wherein the second upper surface is horizontal, and the first upper surface and the second upper surface are connected by an inclined surface, and wherein the locking pawl can face the first upper surface in a state where the locking pawl protrudes to the element guide groove.

6. The slider for a slide fastener according to claim 5, wherein the first upper surface includes: a uniform width portion on the side of the back opening in which an interval between its left and right sides is constant; and a wide portion in which the interval between its left and right sides is gradually enlarged from an end, on the guide post side, of the uniform width portion toward the guide post, wherein the first upper surface extends toward the back opening until at least a point at which extension lines of the left and right sides of the wide portion intersect each other.

7. The slider for a slide fastener according to claim 5, wherein the first upper surface includes: a uniform width portion, its left and right sides being parallel to each other; and a wide portion in which an interval between its left and right sides is gradually enlarged from an end of the uniform width portion on the guide post side, wherein the uniform width portion is adjacent to the inclined surface.

* * * * *

UNITED STATES PATENT AND TRADEMARK OFFICE

CERTIFICATE OF CORRECTION

PATENT NO. : 9,072,347 B2
APPLICATION NO. : 13/820944
DATED : July 7, 2015
INVENTOR(S) : Yoshikazu Hamada et al.

It is certified that error appears in the above-identified patent and that said Letters Patent is hereby corrected as shown below:

Specification

In column 4, line 62, delete “the a” and insert -- the --, therefor.

Signed and Sealed this
Twenty-ninth Day of December, 2015

Michelle K. Lee

Michelle K. Lee
*Director of the United States Patent and Trademark Office*